US011578913B2

(12) United States Patent
Remmel et al.

(10) Patent No.: US 11,578,913 B2
(45) Date of Patent: Feb. 14, 2023

(54) REFRIGERATING DEVICE FOR A RECREATIONAL VEHICLE

(71) Applicant: Dometic Sweden AB, Solna (SE)

(72) Inventors: Marcus Remmel, Roth (DE); Jörg Peter, Meinerzhagen (DE); Michael Steiger, Wenden (DE)

(73) Assignee: Dometic Sweden AB, Solna (SE)

( * ) Notice: Subject to any disclaimer, the term of this patent is extended or adjusted under 35 U.S.C. 154(b) by 0 days.

(21) Appl. No.: 17/536,454

(22) Filed: Nov. 29, 2021

(65) Prior Publication Data

US 2022/0082324 A1 Mar. 17, 2022

Related U.S. Application Data

(63) Continuation of application No. 16/328,079, filed as application No. PCT/EP2017/071052 on Aug. 21, 2017, now Pat. No. 11,187,456.

(30) Foreign Application Priority Data

Aug. 26, 2016 (DE) ..... 10 2016 216 126.1

(51) Int. Cl.
*F25D 29/00* (2006.01)
*F25D 23/12* (2006.01)
*F25D 31/00* (2006.01)

(52) U.S. Cl.
CPC ..... *F25D 29/005* (2013.01); *F25D 23/12* (2013.01); *F25D 31/005* (2013.01); *F25D 2400/361* (2013.01)

(58) Field of Classification Search
CPC ..... F25D 23/12; F25D 29/00; F25D 29/005; F25D 31/005; F25D 2400/361
See application file for complete search history.

(56) References Cited

U.S. PATENT DOCUMENTS

| | | | |
|---|---|---|---|
| 2,166,534 | A | 7/1939 | Rosenfeld |
| 2,541,453 | A | 2/1951 | West |
| 2,624,909 | A | 1/1953 | Khujawa |
| 2,745,132 | A | 5/1956 | Clark et al. |
| 2,790,992 | A | 5/1957 | Campbell |
| 2,885,723 | A | 5/1959 | Altmann |

(Continued)

FOREIGN PATENT DOCUMENTS

| | | | |
|---|---|---|---|
| AU | 2010278016 | B2 | 8/2013 |
| AU | 2010254762 | B2 | 1/2014 |

(Continued)

OTHER PUBLICATIONS

Dometic Product Catalog, Refrigerators, 2015.

(Continued)

*Primary Examiner* — Elizabeth J Martin
(74) *Attorney, Agent, or Firm* — Dinsmore & Shohl LLP

(57) ABSTRACT

A refrigerating device having a refrigerating chamber, which is defined by side walls, an upper wall and a lower wall and a front opening. The refrigerating device further comprises a door which is configured to allow sealing of the front opening and to allow accessing the refrigerating chamber via the front opening, an input panel comprising a display, an input knob and a processing unit. The display depicts a plurality of items which correspond to a plurality of executable input methods to be triggered by a user via actuation of the input knob.

16 Claims, 7 Drawing Sheets

(56) References Cited

U.S. PATENT DOCUMENTS

| | | | |
|---|---|---|---|
| 3,174,193 | A | 3/1965 | Smith |
| 3,403,473 | A | 10/1968 | Navarro |
| 3,889,419 | A | 6/1975 | Maleck |
| 4,014,178 | A | 3/1977 | Kells |
| 4,132,034 | A | 1/1979 | Van Siclen |
| 4,495,673 | A | 1/1985 | Khan |
| 4,503,582 | A | 3/1985 | Gurubatham |
| 4,503,583 | A | 3/1985 | Frohbieter |
| 4,613,174 | A | 9/1986 | Berg et al. |
| 4,893,850 | A | 1/1990 | Mizusawa |
| 4,918,271 | A | 4/1990 | Deeg |
| 5,064,255 | A | 11/1991 | Inui et al. |
| D342,743 | S | 12/1993 | Renner |
| D342,744 | S | 12/1993 | Renner |
| 5,355,556 | A | 10/1994 | Lyon |
| 5,530,992 | A | 7/1996 | Baermann |
| 5,548,927 | A | 8/1996 | Song |
| 5,675,934 | A | 10/1997 | Park |
| 5,829,197 | A | 11/1998 | Oh |
| 5,966,951 | A | 10/1999 | Hallin et al. |
| 5,966,963 | A | 10/1999 | Kovalaske |
| 6,000,771 | A | 12/1999 | Wissinger et al. |
| 6,401,482 | B1 | 6/2002 | Lee et al. |
| D468,325 | S | 1/2003 | Lorek et al. |
| D468,326 | S | 1/2003 | Lorek et al. |
| D468,327 | S | 1/2003 | Lorek et al. |
| 6,543,250 | B1 | 4/2003 | Mills et al. |
| D476,667 | S | 7/2003 | Lorek et al. |
| D495,722 | S | 9/2004 | Avalos Barcenas et al. |
| 6,799,434 | B1 | 10/2004 | Hobbs, Jr. |
| 6,802,155 | B1 | 10/2004 | Kawabata et al. |
| D501,659 | S | 2/2005 | Yamaji |
| 6,868,692 | B2 | 3/2005 | Choi |
| D508,502 | S | 8/2005 | Moseley |
| D540,831 | S | 4/2007 | Kim et al. |
| D542,784 | S | 5/2007 | Franck et al. |
| D544,856 | S | 6/2007 | Hyodo |
| 7,237,402 | B2 | 7/2007 | Hallin et al. |
| D550,256 | S | 9/2007 | Lei et al. |
| D551,658 | S | 9/2007 | Hussaini et al. |
| 7,269,968 | B2 | 9/2007 | Harder et al. |
| 7,278,569 | B2 | 10/2007 | Cohen et al. |
| 7,296,432 | B2 | 11/2007 | Muller et al. |
| D563,998 | S | 3/2008 | Doberstein et al. |
| D578,505 | S | 10/2008 | Tejima et al. |
| 7,516,515 | B2 | 4/2009 | LeimKuehler et al. |
| D595,887 | S | 7/2009 | Blom |
| D604,340 | S | 11/2009 | Kim et al. |
| D607,448 | S | 1/2010 | Hui et al. |
| 7,736,179 | B2 | 6/2010 | Cook et al. |
| D623,154 | S | 9/2010 | Tu |
| 7,913,355 | B2 | 3/2011 | Choi |
| D635,530 | S | 4/2011 | Sung et al. |
| 8,006,515 | B2 | 8/2011 | Hallin et al. |
| 8,020,403 | B2 | 9/2011 | Rotter et al. |
| 8,136,367 | B2 | 3/2012 | Froelicher et al. |
| 8,146,383 | B2 | 4/2012 | Lorek et al. |
| D662,504 | S | 6/2012 | Lohman |
| 8,256,234 | B2 | 9/2012 | Watson et al. |
| D668,111 | S | 10/2012 | Borjesson |
| 8,281,611 | B2 | 10/2012 | Davis et al. |
| D673,144 | S | 12/2012 | Onoue |
| 8,322,805 | B2 | 12/2012 | Kwon et al. |
| D674,391 | S | 1/2013 | Chatterjee et al. |
| 8,375,734 | B2 | 2/2013 | Hall et al. |
| 8,388,078 | B2 | 3/2013 | Kwon et al. |
| 8,424,985 | B2 | 4/2013 | Kwon et al. |
| 8,499,578 | B2 | 8/2013 | Ferragut, II et al. |
| 8,506,026 | B2 | 8/2013 | Kim et al. |
| D691,608 | S | 10/2013 | Samuels et al. |
| 8,544,291 | B2 | 10/2013 | Kim et al. |
| 8,544,973 | B2 | 10/2013 | Kwon et al. |
| 8,567,885 | B2 | 10/2013 | Lee et al. |
| 8,651,330 | B2 | 2/2014 | Krause et al. |
| 8,651,331 | B2 | 2/2014 | Krause et al. |
| 8,677,778 | B2 | 3/2014 | Jeon et al. |
| D701,888 | S | 4/2014 | Schumaker et al. |
| 8,695,371 | B2 | 4/2014 | Boarman et al. |
| 8,701,940 | B2 | 4/2014 | Krause et al. |
| 8,820,583 | B2 | 9/2014 | Kim |
| 8,827,389 | B2 | 9/2014 | Lee et al. |
| 8,875,538 | B2 | 11/2014 | Lee et al. |
| 8,893,523 | B2 | 11/2014 | Talegaonkar et al. |
| 8,925,344 | B2 | 1/2015 | Mitchell et al. |
| 8,944,540 | B2 | 2/2015 | Kim et al. |
| D725,233 | S | 3/2015 | Behling |
| 9,021,828 | B2 | 5/2015 | Vitan et al. |
| 9,022,494 | B2 | 5/2015 | Lehman et al. |
| 9,097,454 | B2 | 8/2015 | LeClear et al. |
| 9,115,924 | B2 | 8/2015 | Leclear et al. |
| D738,938 | S | 9/2015 | Yamada et al. |
| 9,127,871 | B2 | 9/2015 | Bortoletto et al. |
| 9,170,040 | B2 | 10/2015 | An |
| D749,588 | S | 2/2016 | Cox |
| 9,297,573 | B2 | 3/2016 | Krause et al. |
| 9,302,897 | B2 | 4/2016 | Dherde |
| 9,309,103 | B2 | 4/2016 | Ergican et al. |
| D764,028 | S | 8/2016 | Schoenherr et al. |
| D768,129 | S | 10/2016 | Chen |
| D775,408 | S | 12/2016 | Huyghe |
| D782,486 | S | 3/2017 | Nalbandian et al. |
| 9,672,998 | B2 | 6/2017 | Watanabe |
| D803,602 | S | 11/2017 | Hightower et al. |
| D813,189 | S | 3/2018 | Lundgard |
| D826,291 | S | 8/2018 | Lim et al. |
| D839,318 | S | 1/2019 | Meda et al. |
| D849,803 | S | 5/2019 | Meda et al. |
| D865,007 | S | 10/2019 | Meda et al. |
| 10,488,954 | B1 | 11/2019 | Huang |
| D869,441 | S | 12/2019 | Jeong et al. |
| 10,634,417 | B2 | 4/2020 | Xingbiao et al. |
| D884,679 | S | 5/2020 | Lin et al. |
| D887,459 | S | 6/2020 | Olsson et al. |
| 10,697,694 | B2 | 6/2020 | Steiger et al. |
| 10,928,118 | B2 | 2/2021 | Xingbiao et al. |
| 11,187,456 | B2 | 11/2021 | Remmel |
| 2003/0051407 | A1 | 3/2003 | Sosa |
| 2004/0000028 | A1 | 1/2004 | Kim |
| 2004/0148955 | A1 | 8/2004 | Johansson |
| 2004/0172881 | A1 | 9/2004 | Minami |
| 2005/0200253 | A1 | 9/2005 | Wissinger et al. |
| 2005/0218765 | A1 | 10/2005 | Song et al. |
| 2006/0170649 | A1 | 8/2006 | Kosugi et al. |
| 2007/0176527 | A1 | 8/2007 | Sabelhaus et al. |
| 2007/0216272 | A1 | 9/2007 | Park |
| 2007/0227208 | A1 | 10/2007 | Ostberg |
| 2007/0295024 | A1 | 12/2007 | Hallin et al. |
| 2008/0047209 | A1 | 2/2008 | Hinterholzer et al. |
| 2008/0048539 | A1 | 2/2008 | Beek et al. |
| 2008/0202824 | A1 | 8/2008 | Philipp et al. |
| 2008/0203739 | A1 | 8/2008 | Lim et al. |
| 2008/0231159 | A1 | 9/2008 | Lee et al. |
| 2009/0095011 | A1 | 4/2009 | Cho |
| 2009/0142458 | A1 | 6/2009 | McCann |
| 2009/0165478 | A1 | 7/2009 | Devos |
| 2010/0126185 | A1 | 5/2010 | Cho et al. |
| 2010/0218925 | A1 | 9/2010 | Candeo |
| 2011/0036693 | A1 | 2/2011 | Lin et al. |
| 2011/0113810 | A1 | 5/2011 | Mitchell et al. |
| 2011/0162403 | A1 | 7/2011 | Selin et al. |
| 2011/0252813 | A1 | 10/2011 | Veltrop |
| 2012/0000240 | A1 | 1/2012 | Junge et al. |
| 2012/0023998 | A1 | 2/2012 | Oh et al. |
| 2012/0023999 | A1 | 2/2012 | Oh et al. |
| 2012/0024001 | A1 | 2/2012 | Oh et al. |
| 2012/0102999 | A1 | 5/2012 | Anselmino et al. |
| 2012/0146925 | A1 | 6/2012 | An et al. |
| 2012/0159968 | A1 | 6/2012 | Doucet et al. |
| 2012/0167611 | A1 | 7/2012 | Weirich et al. |
| 2012/0222435 | A1 | 9/2012 | Lopes et al. |
| 2012/0279247 | A1 | 11/2012 | Katu et al. |
| 2012/0324918 | A1 | 12/2012 | Bortoletto et al. |
| 2012/0326587 | A1 | 12/2012 | Jeong et al. |
| 2013/0161165 | A1 | 6/2013 | Han |

(56) References Cited

U.S. PATENT DOCUMENTS

| | | | |
|---|---|---|---|
| 2013/0257248 | A1 | 10/2013 | Bedkowski et al. |
| 2014/0049926 | A1 | 2/2014 | Bas et al. |
| 2014/0075844 | A1 | 3/2014 | Walker et al. |
| 2014/0150460 | A1 | 6/2014 | Boarman et al. |
| 2014/0150468 | A1 | 6/2014 | Boarman |
| 2014/0150487 | A1 | 6/2014 | Boarman |
| 2014/0165601 | A1 | 6/2014 | Boarman et al. |
| 2014/0165602 | A1 | 6/2014 | Boarman |
| 2014/0165605 | A1 | 6/2014 | Boarman et al. |
| 2014/0165611 | A1 | 6/2014 | Boarman et al. |
| 2014/0223948 | A1 | 8/2014 | Visin |
| 2014/0246970 | A1 | 9/2014 | Park |
| 2014/0260407 | A1 | 9/2014 | Boehringer et al. |
| 2015/0082812 | A1 | 3/2015 | Boarman et al. |
| 2015/0107285 | A1 | 4/2015 | Mitchell et al. |
| 2015/0123534 | A1 | 5/2015 | Kim et al. |
| 2015/0135762 | A1 | 5/2015 | Eveland et al. |
| 2015/0153093 | A1 | 6/2015 | Junge |
| 2015/0169005 | A1 | 6/2015 | Yanagida |
| 2015/0193073 | A1 | 7/2015 | Dmytriw |
| 2015/0225225 | A1 | 8/2015 | Tae et al. |
| 2015/0247668 | A1 | 9/2015 | Willis |
| 2015/0276305 | A1 | 10/2015 | Hammond et al. |
| 2015/0284237 | A1 | 10/2015 | McMahan et al. |
| 2015/0293661 | A1 | 10/2015 | Gomez |
| 2015/0322694 | A1 | 11/2015 | Carr et al. |
| 2015/0330678 | A1 | 11/2015 | Hu |
| 2015/0330704 | A1 | 11/2015 | Kaymak et al. |
| 2016/0025406 | A1 | 1/2016 | An |
| 2016/0076187 | A1 | 3/2016 | Lee et al. |
| 2016/0076803 | A1 | 3/2016 | Pawar |
| 2018/0018023 | A1 | 1/2018 | Nakamura et al. |
| 2018/0224191 | A1 | 8/2018 | Marolda |
| 2018/0307362 | A1 | 10/2018 | Komala et al. |
| 2019/0086139 | A1 | 3/2019 | Xingbiao et al. |
| 2019/0145140 | A1 | 5/2019 | Zhang et al. |
| 2019/0178564 | A1 | 6/2019 | Steiger et al. |
| 2020/0149334 | A1 | 5/2020 | Lundqvist et al. |
| 2020/0216229 | A1 | 7/2020 | Guan et al. |
| 2020/0378165 | A1 | 12/2020 | Steiger et al. |

FOREIGN PATENT DOCUMENTS

| | | | |
|---|---|---|---|
| AU | 2011248797 | B2 | 10/2014 |
| AU | 2014200864 | B2 | 3/2016 |
| AU | 201710975 | | 3/2017 |
| AU | 201710976 | | 3/2017 |
| AU | 201710992 | | 3/2017 |
| AU | 201710993 | | 3/2017 |
| AU | 201710991 | | 4/2017 |
| AU | 201717910 | | 2/2018 |
| AU | 201717920 | | 2/2018 |
| AU | 201810504 | | 2/2018 |
| AU | 201810505 | | 2/2018 |
| AU | 201810506 | | 2/2018 |
| AU | 201810658 | | 2/2018 |
| AU | 201810730 | | 2/2018 |
| AU | 201810733 | | 2/2018 |
| AU | 2017317557 | A1 | 2/2019 |
| AU | 2019284131 | A1 | 7/2020 |
| AU | 202110915 | | 3/2021 |
| AU | 202110916 | | 3/2021 |
| AU | 202110917 | | 3/2021 |
| AU | 202110918 | | 3/2021 |
| AU | 202110919 | | 3/2021 |
| AU | 202110920 | | 3/2021 |
| CA | 2582586 | A1 | 10/2007 |
| CA | 2638349 | A1 | 6/2009 |
| CA | 2670339 | A1 | 7/2010 |
| CA | 2706048 | A1 | 12/2010 |
| CA | 2757470 | A1 | 12/2010 |
| CA | 2706067 | A1 | 1/2011 |
| CA | 2755035 | A1 | 4/2012 |
| CN | 86206686 | U | 7/1987 |
| CN | 2084092 | U | 9/1991 |
| CN | 2108881 | U | 7/1992 |
| CN | 2150296 | Y | 12/1993 |
| CN | 2203997 | Y | 7/1995 |
| CN | 2209205 | Y | 10/1995 |
| CN | 2227188 | Y | 5/1996 |
| CN | 2243510 | Y | 12/1996 |
| CN | 2263178 | Y | 9/1997 |
| CN | 2272124 | Y | 1/1998 |
| CN | 1172939 | A | 2/1998 |
| CN | 2307895 | Y | 2/1999 |
| CN | 2315255 | Y | 4/1999 |
| CN | 2414148 | Y | 1/2001 |
| CN | 2429799 | Y | 5/2001 |
| CN | 2496973 | Y | 6/2002 |
| CN | 2498302 | Y | 7/2002 |
| CN | 2521560 | Y | 11/2002 |
| CN | 2558937 | Y | 7/2003 |
| CN | 1465837 | A | 1/2004 |
| CN | 2602131 | Y | 2/2004 |
| CN | 2630763 | Y | 8/2004 |
| CN | 1540127 | A | 10/2004 |
| CN | 2675818 | Y | 2/2005 |
| CN | 1690627 | A | 11/2005 |
| CN | 1719168 | A | 1/2006 |
| CN | 2867229 | Y | 2/2007 |
| CN | 101231115 | A | 7/2008 |
| CN | 201144611 | Y | 11/2008 |
| CN | 201152661 | Y | 11/2008 |
| CN | 201165779 | Y | 12/2008 |
| CN | 201173038 | Y | 12/2008 |
| CN | 201386456 | Y | 1/2010 |
| CN | 201434557 | Y | 3/2010 |
| CN | 101787839 | A | 7/2010 |
| CN | 201653044 | U | 11/2010 |
| CN | 201724505 | U | 1/2011 |
| CN | 201756879 | U | 3/2011 |
| CN | 102042733 | A | 5/2011 |
| CN | 202017423 | U | 10/2011 |
| CN | 102251729 | A | 11/2011 |
| CN | 102356289 | A | 2/2012 |
| CN | 102362131 | A | 2/2012 |
| CN | 102362132 | A | 2/2012 |
| CN | 102362134 | A | 2/2012 |
| CN | 202131939 | U | 2/2012 |
| CN | 202361741 | U | 8/2012 |
| CN | 202393147 | U | 8/2012 |
| CN | 202627839 | U | 12/2012 |
| CN | 202673061 | U | 1/2013 |
| CN | 202731625 | U | 2/2013 |
| CN | 202755782 | U | 2/2013 |
| CN | 202788468 | U | 3/2013 |
| CN | 203296635 | U | 11/2013 |
| CN | 103644696 | A | 3/2014 |
| CN | 203605570 | U | 5/2014 |
| CN | 104075531 | A | 10/2014 |
| CN | 203957955 | U | 11/2014 |
| CN | 203957956 | U | 11/2014 |
| CN | 203957958 | U | 11/2014 |
| CN | 203964501 | U | 11/2014 |
| CN | 203964502 | U | 11/2014 |
| CN | 203964503 | U | 11/2014 |
| CN | 203964506 | U | 11/2014 |
| CN | 203964508 | U | 11/2014 |
| CN | 203964522 | U | 11/2014 |
| CN | 203964529 | U | 11/2014 |
| CN | 203964534 | U | 11/2014 |
| CN | 203964546 | U | 11/2014 |
| CN | 203964547 | U | 11/2014 |
| CN | 203980760 | U | 12/2014 |
| CN | 104296467 | A | 1/2015 |
| CN | 204085031 | U | 1/2015 |
| CN | 104328966 | A | 2/2015 |
| CN | 104329879 | A | 2/2015 |
| CN | 104329880 | A | 2/2015 |
| CN | 104332862 | A | 2/2015 |
| CN | 104343305 | A | 2/2015 |
| CN | 204282888 | U | 4/2015 |
| CN | 204359041 | U | 5/2015 |
| CN | 104677021 | A | 6/2015 |

(56) References Cited

FOREIGN PATENT DOCUMENTS

| | | | |
|---|---|---|---|
| CN | 304201123 | S | 7/2017 |
| CN | 304444504 | S | 1/2018 |
| CN | 109059413 | A | 12/2018 |
| CN | 109642768 | A | 4/2019 |
| CN | 109642769 | A | 4/2019 |
| CN | 209623184 | U | 11/2019 |
| CN | 209893773 | U | 1/2020 |
| DE | 4428051 | A1 | 2/1995 |
| DE | 69301581 | T2 | 7/1996 |
| DE | 20021162 | U1 | 3/2001 |
| DE | 20204297 | U1 | 8/2002 |
| DE | 10256954 | A1 | 10/2003 |
| DE | 10307756 | A1 | 9/2004 |
| DE | 202004016063 | U1 | 2/2006 |
| DE | 202006007926 | U1 | 7/2006 |
| DE | 20221876 | U1 | 12/2008 |
| DE | 102012224167 | A1 | 7/2014 |
| DE | 102014200806 | A1 | 7/2015 |
| DE | 102016216126 | A1 | 3/2018 |
| DE | 102018213817 | A1 | 2/2019 |
| DE | 102017208901 | B4 | 6/2020 |
| DE | 102019200070 | A1 | 7/2020 |
| EP | 1096088 | B1 | 4/2004 |
| EP | 1492987 | A1 | 1/2005 |
| EP | 1538409 | A2 | 6/2005 |
| EP | 1329679 | B1 | 1/2007 |
| EP | 1873468 | A2 | 1/2008 |
| EP | 1895085 | A2 | 3/2008 |
| EP | 1953483 | A2 | 8/2008 |
| EP | 2054684 | A2 | 5/2009 |
| EP | 2426448 | A2 | 3/2012 |
| EP | 2430379 | A2 | 3/2012 |
| EP | 2492621 | A2 | 8/2012 |
| EP | 2562499 | A1 | 2/2013 |
| EP | 2717006 | A1 | 4/2014 |
| EP | 2738486 | A2 | 6/2014 |
| EP | 2765488 | A2 | 8/2014 |
| EP | 2896917 | A1 | 7/2015 |
| EP | 2133641 | B1 | 11/2015 |
| EP | 2998670 | A2 | 3/2016 |
| EP | 3287722 | A1 | 2/2018 |
| EP | 2357436 | B1 | 3/2018 |
| EP | 2405216 | B1 | 9/2018 |
| EP | 2927628 | B1 | 9/2018 |
| EP | 2998671 | B1 | 9/2018 |
| EP | 3475635 | A1 | 5/2019 |
| EP | 2908075 | B1 | 6/2019 |
| GB | 191316555 | A | 5/1914 |
| GB | 2107768 | A | 5/1983 |
| GB | 2209794 | B | 7/1991 |
| JP | 52048247 | A | 4/1977 |
| JP | 52048248 | A | 4/1977 |
| JP | 52048250 | A | 4/1977 |
| JP | S5721169 | A | 2/1982 |
| JP | H02154972 | A | 6/1990 |
| JP | 2247479 | A | 10/1990 |
| JP | 2247480 | A | 10/1990 |
| JP | H02275278 | A | 11/1990 |
| JP | H0371087 | U | 7/1991 |
| JP | H03204581 | A | 9/1991 |
| JP | 3271476 | A | 12/1991 |
| JP | H04148180 | A | 5/1992 |
| JP | 4186011 | A | 7/1992 |
| JP | H06201253 | A | 7/1994 |
| JP | 7109864 | A | 4/1995 |
| JP | 7317441 | A | 12/1995 |
| JP | 9264091 | A | 10/1997 |
| JP | 11248339 | A | 9/1999 |
| JP | 11324518 | A | 11/1999 |
| JP | 3161680 | B2 | 4/2001 |
| JP | 2005164230 | A | 6/2005 |
| JP | 4020687 | B2 | 12/2007 |
| JP | 2008008610 | A | 1/2008 |
| KR | 200166856 | Y1 | 2/2000 |
| KR | 2004042748 | A | 5/2004 |
| KR | 2005027875 | A | 3/2005 |
| KR | 100756464 | B1 | 9/2007 |
| KR | 100880487 | B1 | 1/2009 |
| KR | 101005189 | B1 | 1/2011 |
| KR | 2014111723 | A | 9/2014 |
| TR | 199901774 | A2 | 3/2001 |
| TR | 200003328 | A2 | 6/2002 |
| TW | 200835840 | A | 9/2008 |
| WO | 03085339 | A1 | 10/2003 |
| WO | 2015078307 | A1 | 6/2015 |
| WO | 2015078311 | A1 | 6/2015 |
| WO | 2015078313 | A1 | 6/2015 |
| WO | 2015078314 | A1 | 6/2015 |
| WO | 2015078315 | A1 | 6/2015 |
| WO | 2015078316 | A1 | 6/2015 |
| WO | 2015078317 | A1 | 6/2015 |
| WO | 2015107118 | A1 | 7/2015 |
| WO | 2016026741 | A1 | 2/2016 |
| WO | 2018036975 | A1 | 3/2018 |
| WO | 2018037038 | A1 | 3/2018 |

OTHER PUBLICATIONS

Dometic Product Catalog, Refrigerators, 2016.

Notice of Allowance issued in U.S. Appl. No. 16/327,492, dated Feb. 5, 2020.

Intention to Grant dated Jan. 31, 2020 for EP Application No. 16185380.9 filed on Aug. 23, 2016 entitled "Cabinet for a Recreational Vehicle".

Corrected Notice of Allowance issued in U.S. Appl. No. 16/327,492, dated Apr. 10, 2020.

Office Action for Germany Patent Application No. 102019207919.9 dated Mar. 4, 2020 (Summary in English attached).

Office Action for Germany Patent Application No. 102019209297.7 dated Mar. 12, 2020 (Summary in English attached).

Corrected Notice of Allowance issued in U.S. Appl. No. 16/327,492, dated May 13, 2020.

Decision to Grant mailed in EP Patent Application No. 16185380.9 dated Jun. 18, 2020.

Office Action for China Patent Application No. 201780051244.4 dated Jun. 17, 2020.

Non Final Office Action for US Design U.S. Appl. No. 29/641,674 dated Oct. 1, 2020.

Office Action Issued in Chinese Patent Application No. 201780051244.4 dated May 25, 2021.

U.S. Appl. No. 16/884,698 entitled "Refrigerator with double-hinge Door" filed May 27, 2020.

Second Office Action issued in China Patent Application No. 201780051244.4 dated Feb. 19, 2021.

European Patent Office, International Search Report and Written Opinion for PCT/EP2017/071052 dated Oct. 5, 2017.

AU Patent Application No. 2017316505 filed on Feb. 6, 2019.

EU Design Patent Application No. 003351253-0001-0016 filed on Aug. 24, 2016.

EU Design Patent Application No. 003351444-0001-0010 filed on Aug. 24, 2016.

CN Notice of Grant the Patent Right for Design Application received in 201730050701.0 dated Nov. 17, 2017.

CN First Office Action for Design Application received in 201730050701.0 on Jul. 7, 2017.

Requirement for Restriction/Election issued in U.S. Appl. No. 29/594,930 dated Jan. 1, 2018.

Notice of Allowance issued in U.S. Appl. No. 29/594,930 dated Sep. 6, 2018.

U.S. Appl. No. 29/641,674 entitled "Control Panel" filed Mar. 23, 2018.

Non-Final Office Action issued in U.S. Appl. No. 29/594,936 dated Oct. 19, 2018.

Notice of Allowance issued in U.S. Appl. No. 29/594,936 dated Jan. 10, 2019.

CN Notice of Granting Patent Right for Design Application received in 201730050365.X dated Jun. 2, 2017.

DE Patent Application No. 102019209297.7 filed on Jun. 26, 2019.

DE Patent Application No. 102019207919.9 filed on May 29, 2019.

(56) References Cited

OTHER PUBLICATIONS

Non-Final Office Action issued in U.S. Appl. No. 16/327,492 dated Jun. 27, 2019.
European Patent Office, International Search Report and Written Opinion for PCT/EP2017/071216 dated Nov. 11, 2017.
European Patent Office, European Search Report and Opinion for 16185380.9 dated Feb. 17, 2017.
U.S. Appl. No. 63/034,128, filed Jun. 3, 2020 titled "Refrigerator".
U.S. Appl. No. 16/198,009, filed Nov. 21, 2018 titled "Molded Frame for a Reversible Appliance Door".
U.S. Design U.S. Appl. No. 29/715,466, filed Dec. 2, 2019 titled "Refrigerator Appliance".
Advisory Action issued in U.S. Appl. No. 16/328,079 dated Mar. 10, 2021.
Final Office Action issued in U.S. Appl. No. 16/328,079 dated Nov. 24, 2020.
International Preliminary Report on Patentability for PCT Application No. PCT/EP2017/071052 dated Feb. 26, 2019.
International Preliminary Report on Patentability for PCT Application No. PCT/EP2017/071216 dated Feb. 26, 2019.
Non Final Office Action Issued in U.S. Appl. No. 16/328,079 dated Apr. 5, 2021.
Notice of Allowance Issued in U.S. Appl. No. 16/328,079 dated Jul. 30, 2021.
U.S. Appl. No. 16/328,079 entitled "Refrigerating device for a recreational vehicle" filed Feb. 25, 2019.
Rejection Decision Issued in China Application No. 201780051244.4 dated Jan. 10, 2022.
Decision to Grant Issued in German Patent Application No. 102019209297.7 dated Feb. 2, 2022.
Office Action Issued in German Application No. 102019207919.9 dated Dec. 22, 2021.
Office Action Issued in European Patent Application No. 17758842.3 dated Feb. 16, 2022.
Examination Report Issued in Australian Patent Application No. 2017317557 dated Apr. 7, 2022.
Examination Report Issued in Australian Patent Application No. 2017316505 dated Apr. 28, 2022.
Non Final Office Action Issued in U.S. Appl. No. 16/884,698 dated Jun. 8, 2022.
Office Action for EP Patent Application No. 177588423 dated Jul. 13, 2020.
Office Action for China Patent Application No. 2017800518667 dated Aug. 24, 2020.
Notice of Acceptance Issued in Australian Patent Application No. 2017317557 dated Dec. 13, 2022.

REFRIGERATING DEVICE FOR A RECREATIONAL VEHICLE

CLAIM TO PRIORITY

This continuation patent application claims priority to and benefit of, under 35 U.S.C. § 120, U.S. 371 National Stage Patent Application with Ser. No. 16/328,079, filed Feb. 25, 2019, which claims priority to PCT Patent Application with Serial Number PCT/EP2017/071052, filed Aug. 21, 2017, which claims priority to DE Patent Application with Serial Number 102016216126.1, filed Aug. 26, 2016, all of which is incorporated by reference herein.

BACKGROUND

1. Field of the Invention

The present embodiments relate to a refrigerating device a recreational vehicle and in particular to a refrigerator for a recreational vehicle.

2. Description of the Related Art

A recreational vehicle in the sense of the invention may be a caravan, a mobile home, a yacht or any other vehicle being equipable with a refrigerating device. Such refrigerating devices comprise a refrigerating chamber that is defined by side walls, an upper and a lower wall and a front opening. Such refrigerating devices further comprise a door, which is configured to allow sealing of the front opening and to allow accessing the refrigerating chamber via the front opening, an input panel comprising a display, an input knob and a processing unit.

Recreational vehicles in general have limited space available for built-in components like refrigerating devices. Furthermore, refrigerating devices for recreational vehicles may require a much increased user interaction compared to refrigerating devices for stationary applications. More specifically, mobile refrigerating devices may have the option of selecting a specific source of power, adjusting the refrigerating temperature in order to maintain energy efficiency and also turning the mobile refrigerating device on and off again, which is most likely occurring more frequently compared to stationary applications of refrigerating devices.

Therefore, it is generally desired to provide a user-friendly interface for a convenient operation of the refrigerating device. The object of this invention is therefore to provide all relevant inputs for controlling the refrigerating device in a convenient and small in dimension set-up which is user-friendly and easy to use and operate.

SUMMARY

The object is achieved by means of a refrigerating device with the features of claim 1. Favorable developments are provided in the dependent claims.

One embodiment of the refrigerating device for a recreational vehicle comprises a refrigerating chamber which is defined by side walls, an upper and a lower wall and a front opening. The refrigerating device further comprises a door which is configured to allow sealing of the front opening and to allow accessing the refrigerating chamber via the front opening, an input panel comprising a display, an input knob and a processing unit, wherein the display depicts a plurality of items which correspond to a plurality of executable input methods to be treated by a user via actuation of the input knob.

The refrigerating device according to the present invention thus has a panel that allows triggering all relevant commands for operating the refrigerator via an input knob and by means of selecting depicted items on a display. Processing user inputs via the input knob as well as computing the display is achieved by a processing unit. The terms "executable input method" relates to a predetermined algorithm or computational method for controlling an arbitrary component of the refrigerating device.

In some embodiments, each item of the plurality of items depicted on the display corresponds to a specific executable input method selected from the list, including setting a refrigerating temperature, preparing crushed ice or ice cubes, setting the source of energy, defrosting the refrigerating chamber, setting an alarm, controlling ventilation of the refrigerating chamber and adjusting the volume or light. Obviously, the list of specific executable input methods as provided before is not restricted thereto and may include any other executable input method useful for operating a refrigerating device. In some embodiments, the item depicted on the display which corresponds to a specific executable input method is depicted in a manner that allows anticipation of the intended functionality by intuition. In view of the above, the user may quickly identify the desired executable input method and trigger the same via actuation of the input knob.

In some embodiments, the input panel is fixedly mounted to the housing of the refrigerating device. By means of such a fixed arrangement, damages of the input panel, caused for example by accidental slamming of the door against objects inside the recreational vehicle, is substantially reduced. In some embodiments, the input panel is integrated into the body of the refrigerating device such that it is integrated smoothly and substantially without gaps between the input panel and the refrigerating device.

In one embodiment, the refrigerating device comprises a first refrigerating chamber and a second refrigerating chamber, whereas the first refrigerating chamber is a freezer and the second refrigerating chamber is a refrigerator. Controlling the later combination of refrigerating chambers may be achieved either by controlling both chambers via one control panel or by controlling each chamber via an individual control panel. Alternatively, the refrigerating device may comprise a different further refrigerating chamber which is accommodated on the inside of the refrigerating device.

The term "refrigerating chamber" however is not limited thereto. According to the present embodiments, it is also possible to provide a chamber in addition to or as substitution for an already present refrigerating chamber. For instance, a combination of a refrigerating chamber with a cabinet, a microwave, an oven or the like into the refrigerating device is also possible to be controlled via the input panel. Accordingly thereto, one embodiment constitutes a combination of a refrigerating chamber with an oven. The refrigerating device of the present invention, thus, preferably comprises a further chamber, whereas the further chamber is an oven. The oven is also connected with and to be controlled via the input panel. With this preferred configuration, the present invention provides a one compact device for heating and cooling which is centrally controllable by one input panel. The plurality of items depicted by the display, thus, further correspond to a plurality of executable input methods for the oven to be triggered by a user via actuation of the input knob.

In some embodiments, the specific executable input methods concerning the oven include one or more methods selected from the list consisting of turning gas on and off, setting a heating temperature, setting a heating mode like, for example, top heat, bottom heat, circulating air, rotisserie grill and combinations thereof, various time settings like, for example, a starting time and a duration for the heating, setting an alarm, controlling ventilation of the oven chamber, setting light settings and adjusting the volume.

In at least one embodiment, the oven is the top chamber of the refrigerating device of the present invention. This is advantageous since air warmed from the oven rises to the top which would adversely affect the refrigerating chamber if it would be the other way round.

In some embodiments, the input panel placed above and/or below a door of a refrigerating chamber of a refrigerating device, such that the panel is substantially at the same height as an upper and/or a lower wall of a refrigerating chamber of the refrigerating device. Thus, the spaces above or below a door of a refrigerating chamber may effectively be consumed by the panel according to the embodiments. Advantageously, formerly dead space is now effectively used, thus the overall dimensions of the refrigerating device may be reduced. In one embodiment, the control panel is placed such that it is directly adjacent to a horizontal door of the refrigerating device.

In some embodiments, the processing unit operatively connects the display unit display knob such that triggering an input method is achieved by rotating the input knob to select at least one of the depicted items corresponding to the desired input method and by pressing the input knob to execute the desired input method corresponding to the selected depicted item. Here, triggering an input method requires two inputs, namely a) selecting of an item by means of rotating the knob and b) execution of the input method that corresponds to the selected item by pressing the input knob. This approach provides an easy to use, easy to understand and failure-safe triggering of a desired input method. The input knob therefore has two degrees of freedom, namely rotation about its access of rotation and lateral movement along its access of rotation. Naturally, further degrees of freedom might be introduced for selecting and/or executing input methods, for example tilting the knob about its access of rotation or laterally shifting the knob in parallel to its access of rotation. Furthermore, pressing the input knob may optionally also open a sub-menu which is depicted on the display after pressing the input knob. In general, rotating the input knob corresponds to swiping through menu items and pressing the knob corresponds to confirming or activating the currently selected item.

The door of the refrigerating device may be hinged at a left and/or right side of the refrigerating chamber and comprises at leas (one handle to access the refrigerating chamber. In a preferred embodiment, the handle is a vertical notch, protruding into the inside of the door of the refrigerating device. Preferably, the door of the refrigerating device may be open both to the left side and to the right side by means of suitable left and right hinge and locking mechanisms.

The panel may constitute an integral part of the refrigerating device. In the sense of the embodiments, the input panel of the refrigerating device incorporates further functionalities, such as providing parts of the housing structure, providing a supporting structure or constituting a part of the frame of the refrigerating device. It is advantageous, to integrate the input panel such that it is easily to be connected with the devices to be controlled via the input panel.

The input panel forms a substantially even surface and the input knob is the only protruding component on the input panel. In the sense of the embodiments, the presence of gaps, protrusions or recesses shall be reduced to a minimum, in order to reduce the chance of dirt, dust or food remains accumulating on the input panel. By doing so, cleaning of the outside surfaces of the refrigerating device may easily be achieved. Also, during times without constantly maintained cleaning procedures, for example during times when the recreational vehicle is not used, accumulation or growth of potentially harmful substances or biologic material on the input panel is minimized. Therefore, no other protrusion except for the protruding input knob shall be present. The display of the input panel is covered by a transparent section of an input panel cover, in order to achieve an even surface with respect to the input panel and the adjacent components of the refrigerating device.

The input knob may be the only controlling device on the input panel. In the sense of the invention, the user inputs for controlling the refrigerating device shall only be provided via the input knob, in order to reduce the complexity of production, assembly and maintenance of the input panel. Also, the user interaction is much more intuitive, hence fail safe, if only one input knob is present.

BRIEF DESCRIPTION OF THE DRAWINGS

The invention will now be described in more detail with reference to the figures showing a preferable embodiment, wherein.

DETAILED DESCRIPTION

Figure 1:
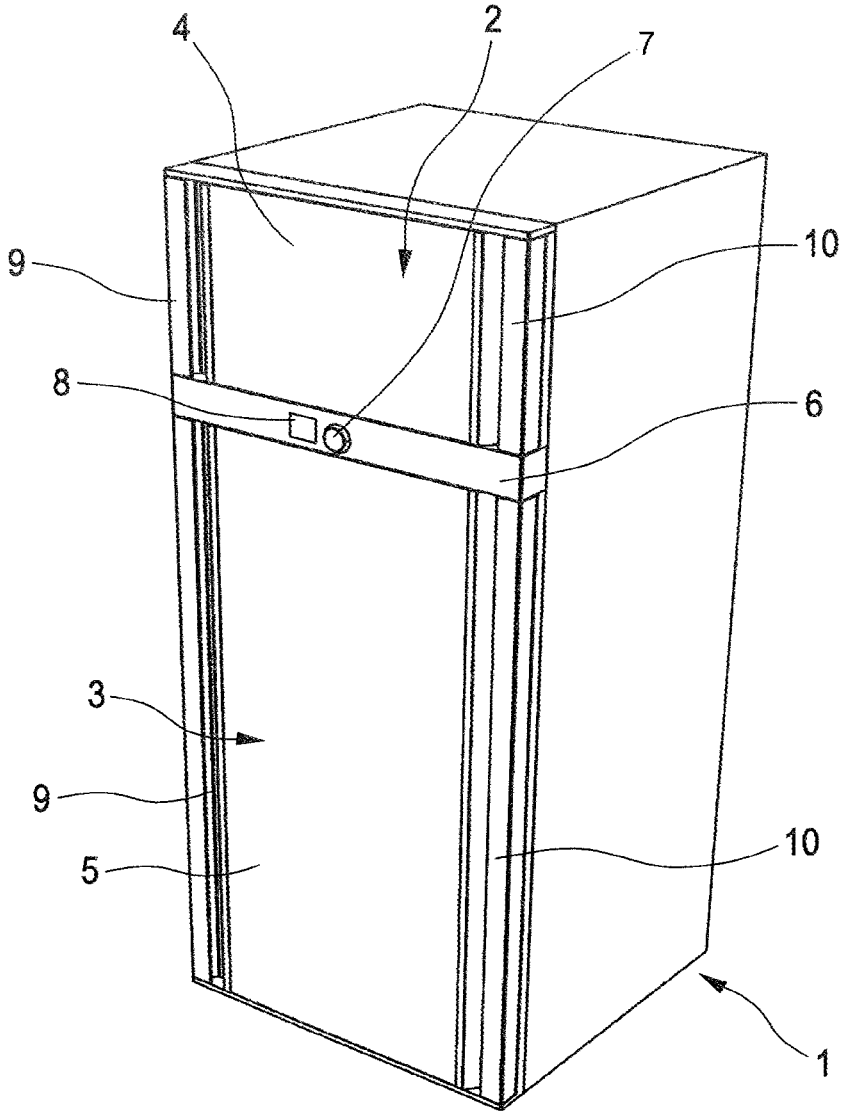
FIG. 1 is a prospective view of the refrigerating device according to a first embodiment of the invention comprising a first refrigerating chamber and a second refrigerating chamber.

In this particular embodiment of FIG. 1 the refrigerating device 1 comprises a first refrigerating chamber 2, e.g. a freezing compartment, and a second refrigerating chamber 3, e.g. a cooling compartment. Accordingly, the first refrigerating chamber has a first door 4 and a second refrigerating chamber 3 has a second door 5. In between the first door 4 and the second door 5 on the front side of the refrigerating device 1 is provided an input panel 6 with an input knob 7 and a display 8. Each of the first door 4 and the second door 5 comprises a left handle 9 and a right handle 10 for individually and selectively opening the first door 4 and/or the second door 5 to either the left or the right side. Thereby, the input panel 6 remains stationary attached to the refrigerating device 1. The input panel is further shaped such that it follows the encompassing surface of the refrigerating device without forming protrusions or recesses. The input panel 6 is further provided in a height that corresponds with the lower wall of the first refrigerating chamber 2 and the upper wall of the second refrigerating chamber 3 in order to make use of the dead space in between the first refrigerating chamber 2 and the second refrigerating chamber 3.

Figure 2:
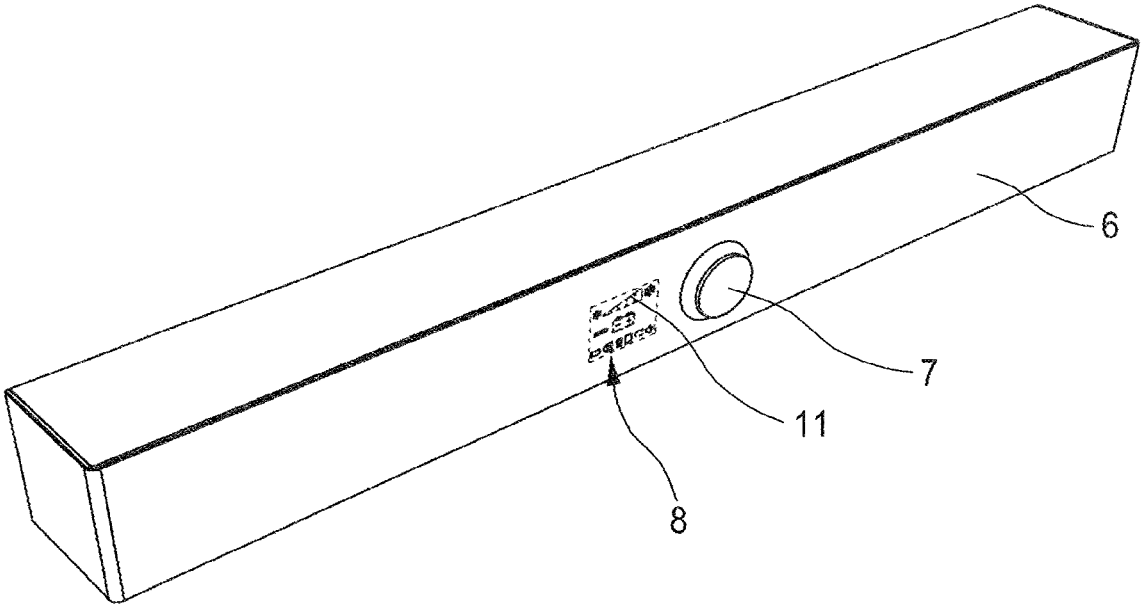
FIG. 2 is a prospective view of an isolated input panel according to the invention.

In FIG. 2, the input panel is shown in more detail. It is shown that the input knob has a circular shape and is provided on the right side next to a rectangular display 8 showing a plurality of items 11 which correspond to specific executable input methods and operating modes that may be selected by rotating the input knob 7 and which may be executed by pressing the input knob 7 when the desired item 11 is selected.

Figure 3:
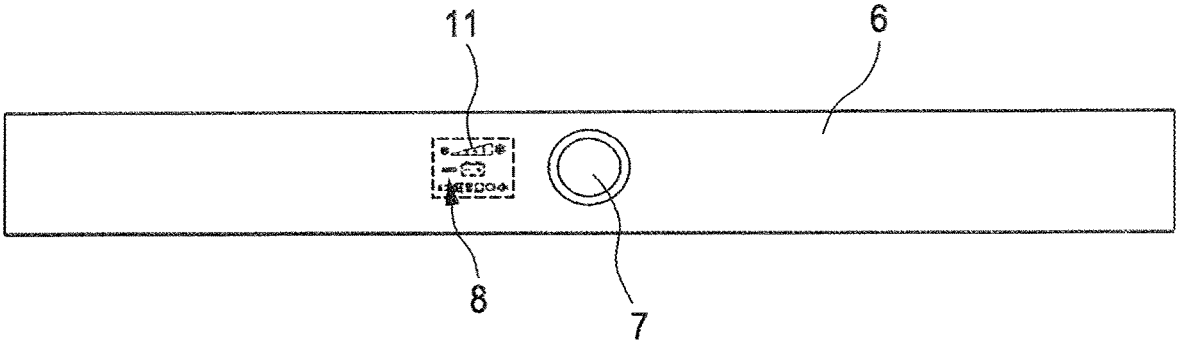
FIG. 3 is a front view of an isolated input panel according to the invention.
Figure 4:
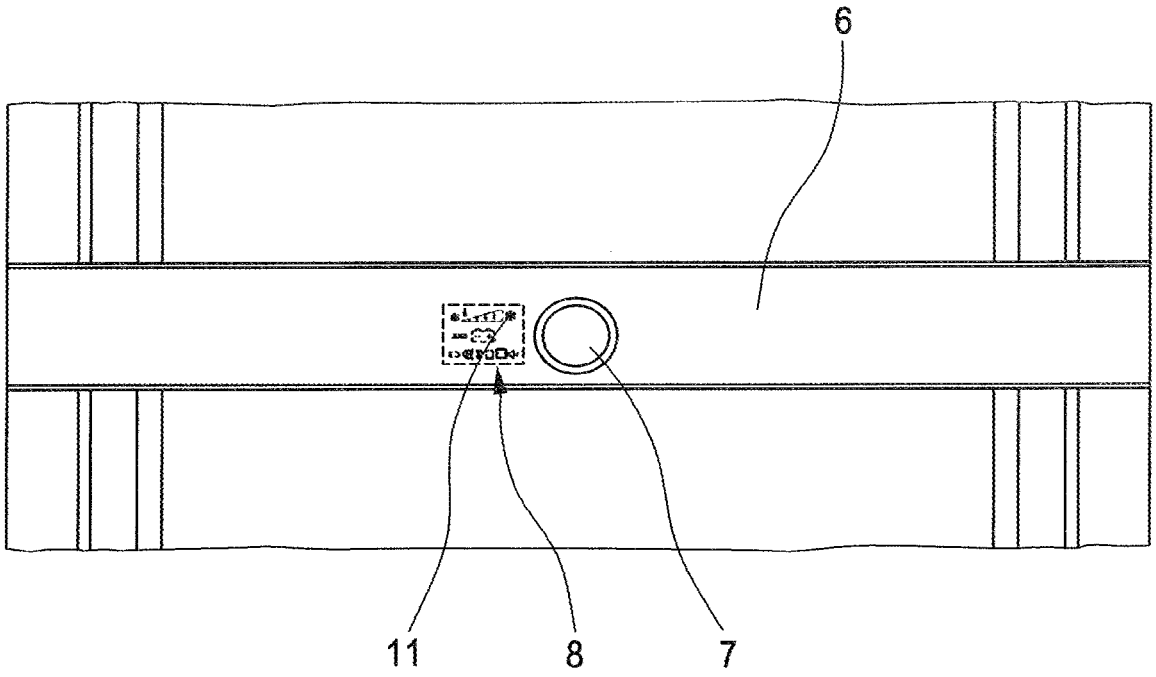
FIG. 4 is section of a refrigerating device according to a first embodiment of invention in a front view showing the input panel.

FIG. 3 shows a front w of the isolated input panel 6 and FIG. 4 the input panel 6 as shown in FIG. 3 in combination with the refrigerating device 1. Here it is shown a plurality of items 11 consisting of symbols representing temperature, battery, power source, defrosting, volume control, ventilation and the like.

Figure 5:
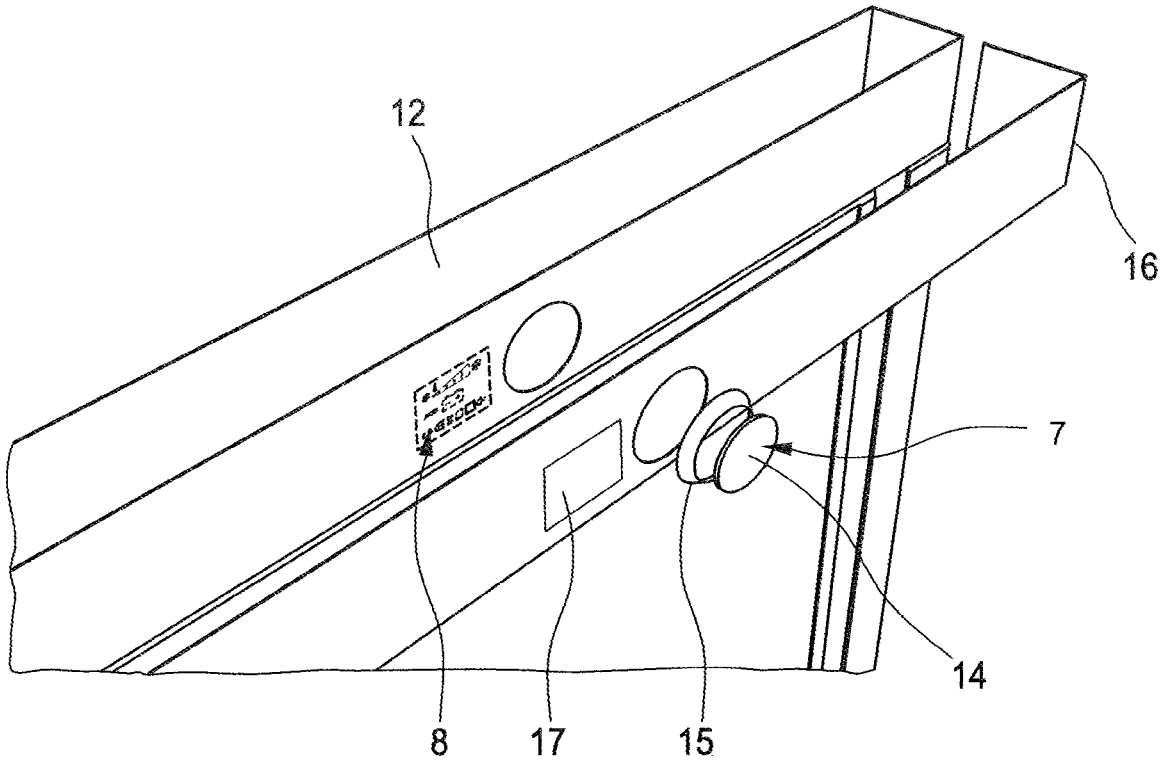
FIG. 5 is an exploded view of the input panel according to the invention.

The individual components of the panel 6 are further shown in FIG. 5. The input panel 6 mainly consists of an input panel core 12, housing the processing unit (not shown), and the display 8, the input knob 7, consisting of a circumferential plate 14 and a ring 15 as well as a cover panel 16. The ring 15 is placed in between the cover panel 16 and the circumferential plate 14. The input panel 6 further comprises a transparent section 17 which aligns with the display 8 that is provided in the input panel core 12 in position and dimension. Thus, the display 8 may conveniently be observed in a mounted condition of the input panel 6, whilst being protected through the cover panel 16.

Figure 6:
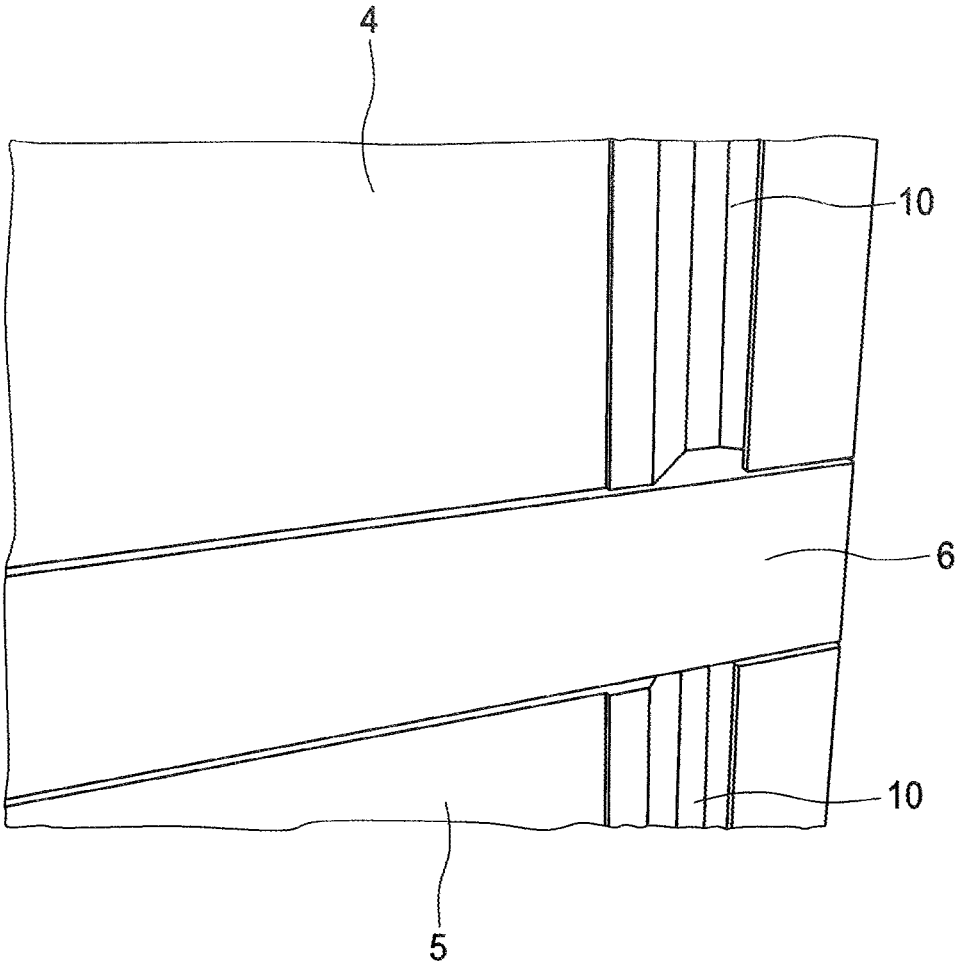
FIG. 6 is a prospective sectional view of a refrigerating device according to a first embodiment of the invention.

FIG. 6 shows a prospective sectional view of a refrigerating device 1 according to a first embodiment of the invention. It can be seen that the input panel 6 is located adjacent to the first door 4 of the first refrigerating chamber 2 and the second door 5 of the second refrigerating chamber 3. Furthermore, each of the first door 4 of the first refrigerating chamber 2 and the second door 5 of the second refrigerating chamber 3 have vertical left and right handles 9, 10 to open the doors 4, 5 individually and selectively either to the right side or to the left side.

Figure 7:
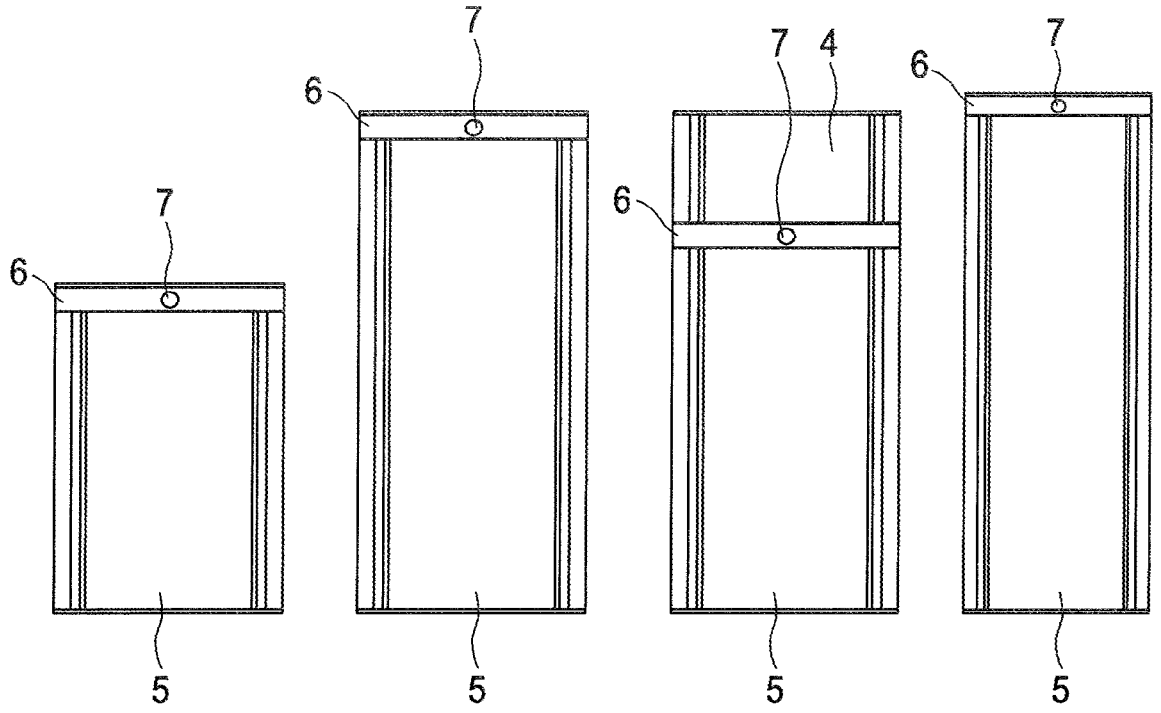
FIG. 7 is a front view showing several embodiments of a refrigerating device 1 for a recreational vehicle.

FIG. 7 depicts a variety of further embodiments of a refrigerating device 1 according to the invention. Accordingly, the refrigerating device 1 may either have only one refrigerating chamber, or a first refrigerating chamber 2 and a second refrigerating chamber 3. In either embodiment, the input panel 6 is fixedly provided on the front of the refrigerating device 1 above and/or below a door of the refrigerating chamber of the refrigerating device. The latter is specifically useful, since normally, this dead space would be covered by the doors or an additional blind. Here, the usually unused space is turned into a conveniently reachable space for housing the input panel 6.

The invention claimed is:

1. A refrigerating device, comprising:

a housing having an upper wall, a lower wall, a first sidewall, and a parallel second side wall, both extending between said upper wall and said lower wall;

a first chamber having a first front opening and a second chamber having a second front opening, said first and second openings arranged vertically within said housing;

a first door configured to seal the first chamber and allow access to said first chamber;

a second door configured to seal the second chamber and allow access to said second chamber;

an input panel is horizontally disposed between said first chamber and said second chamber on said housing; and, a display and an input knob disposed on said input panel, wherein said display depicts a plurality of items which correspond to a plurality of executable input methods to be triggered by a user via rotation and pressing of the input knob.

2. The refrigerating device according to claim 1, wherein the first door and the second door of the refrigerating device are each hinged at a left and right side of the first and second chambers and each said first door and said second door comprises at least one handle to access the first and second chambers, respectively.

3. The refrigerating device according to claim 1, wherein each item of the plurality of items depicted on the display corresponds to a specific executable input method selected from a list, including one of or a plurality of setting a refrigeration temperature, preparing crushed ice or ice cubes, setting a source of energy, defrosting the first chamber or the second chamber, setting an alarm, controlling ventilation of the first or the second chamber, setting light settings or adjusting audible volume.

4. The refrigerating device according to claim 1, further comprising the display being operably connected with the input knob such that triggering an input method is achieved by said rotation the input knob to select at least one of the depicted items corresponding to the input method and by said pressing the input knob to execute the desired input method corresponding to the selected depicted item.

5. The refrigerating device according to claim 1, wherein the input panel is fixedly mounted to the housing of the refrigerating device between the first door and the second door.

6. The refrigerating device according to claim 1, wherein the input panel is at the same height as a space between the first door and the second door of the refrigerating device.

7. The refrigerating device according to claim 1, wherein the input panel further comprises a cover panel with a transparent section.

8. The refrigerating device according to claim 1, wherein the input panel constitutes an integral part of the refrigerating device.

9. The refrigerating device according to claim 1, wherein the input panel forms a flat surface and the input knob is the only protruding component on the input panel.

10. The refrigerating device according to claim 1, wherein the input knob is the only controlling device on the input panel.

11. The refrigerating device according to claim 1, wherein the first chamber is a freezer and the second chamber is a refrigerator.

12. The refrigerating device according to claim 1, wherein the second chamber is an oven chamber.

13. The refrigerating device according to claim 12, wherein each item of the plurality of items depicted on the display corresponds to a specific executable input method, whereas the plurality of executable input methods for specifically controlling the oven chamber includes one or more methods selected from a list consisting of turning gas on and off, setting a heating temperature, setting a heating mode, various time settings, controlling ventilation of the oven chamber, setting light settings or adjusting audible volume.

14. The refrigerating device according to claim 12, wherein the oven chamber is a top chamber of the first and second chambers of the refrigerating device.

15. The refrigerating device according to claim 13, wherein the heating mode comprises top heat, bottom heat, circulating air, rotisserie grill or combinations thereof.

16. The refrigerating device according to claim 13, wherein the various time settings comprise a starting time and a duration for the heating, and setting an alarm.

* * * * *